United States Patent [19]

Latone

[11] Patent Number: 4,536,031

[45] Date of Patent: Aug. 20, 1985

[54] BACK SUPPORT CONTROL MECHANISM FOR A CHAIR OR THE LIKE

[75] Inventor: Thomas L. Latone, Quakertown, Pa.

[73] Assignee: Knoll International, Inc., New York, N.Y.

[21] Appl. No.: 503,226

[22] Filed: Jun. 10, 1983

[51] Int. Cl.[3] ..... A47C 7/40

[52] U.S. Cl. ..... 297/353; 248/337; 297/374; 297/383; 403/104

[58] Field of Search ..... 297/363, 357, 374, 383, 297/410; 248/337; 403/104, 374

[56] References Cited

U.S. PATENT DOCUMENTS

| | | | |
|---|---|---|---|
| 2,817,548 | 12/1957 | Uthemann | 403/104 |
| 3,692,356 | 9/1972 | Mertens | 297/410 X |
| 4,017,118 | 4/1977 | Cawley | 397/410 X |
| 4,029,279 | 6/1977 | Nakatani | 248/337 X |
| 4,170,382 | 10/1979 | Wheeler | 297/353 X |
| 4,174,900 | 11/1979 | Ina | 248/337 X |
| 4,185,936 | 1/1980 | Takahashi | 403/104 |

FOREIGN PATENT DOCUMENTS

| | | | |
|---|---|---|---|
| 3017163 | 11/1981 | Fed. Rep. of Germany | 297/353 |

*Primary Examiner*—Francis K. Zugel

*Assistant Examiner*—Peter R. Brown

*Attorney, Agent, or Firm*—Robert Scobey

[57] ABSTRACT

A back support control mechanism for a chair or the like is provided for a back support movable toward and away form a seat. Adjustable positioning of the back support with respect to the seat in an infinite number of positions in a range of movement of the back support is provided through use of a channel member fixed with respect to the seat and a pressure pad positioned within the channel member and fixed with respect to the back support. The pressure pad slides within the channel member, and a lever is coupled to the pressure pad through a spring plate. The lever is movable with the pressure pad and with respect thereto, and has a cam surface thereon which, in one position of the lever with respect to the pressure pad, bears against the pressure pad through the spring plate, causing the pressure pad to bear against the channel member to fix the pressure pad in position with respect to the channel member and to prevent further movement of the pressure pad, thereby to fix the position of the back support with respect to the seat. A stop pin is carried by the channel member which extends into a slot in the pressure pad. A terminal end of the slot limits the range of movement of the back support with respect to the seat.

4 Claims, 20 Drawing Figures

BACK SUPPORT CONTROL MECHANISM FOR A CHAIR OR THE LIKE

BACKGROUND AND BRIEF DESCRIPTION OF THE INVENTION

This invention relates to a back support control mechanism for a chair or the like. The invention is directed to providing adjustable positioning of a back support with respect to a seat in an infinite number of positions in a range of movement of the back support.

In the past, back support control mechanisms have been employed, permitting a back support of a chair to be moved forwardly and rearwardly with respect to a seat through a range of movement, but limited to discrete positions within the range rather than an infinite number of positions within that range. Other arrangements have been employed, using a threaded shaft, which does provide for infinite adjustment within the range, but which is relatively cumbersome to use since it requires the turning of a control knob a large number of times to complete movement of the back support throughout its entire range of travel. Adjustment of the back support in such mechanisms is relatively slow and time consuming. Other arrangements have been utilized, incorporating a slotted support and lock nuts which must be loosened and tightened every time the back support is moved.

The present invention provides an infinitely adjustable back support control mechanism which overcomes the disdvantages noted above. Adjustment of the back support is achieved easily and quickly over any portion or all of the range movement of the back support. The invention involves use of a pressure pad fixed with respect to the back support which is positioned within a channel member that is fixed with respect to the seat. The pressure pad may slide within the channel member, limited in its movement therein by a stop pin. A lever is coupled to the pressure pad and is movable therewith and with respect thereto, and a cam surface on the lever exerts pressure against the pressure pad through a spring plate. Close manufacturing tolerances which would otherwise be required are obviated by use of the spring plate. The lever in one position permits free movement of the pressure plate within the channel member. In another position of the lever, the pressure plate is made to bear against the channel member to prevent further movement of the pressure pad, thereby fixing the position of the back support with respect to the seat.

The back support is preferably a tubing that includes a carrier therein that holds the pressure pad. That carrier preferably is formed of side rails, with the pressure pad being supported between the rails. The rails in turn ride on tracks along the sides of the channel member. The channel member is positioned within the tubing that forms the back support, and hence the entire adjustment mechanism is basically concealed from view, with the exception of the operating lever which extends beneath the back support tubing in a position convenient for access thereto. The lever is simply actuated to permit adjustment of the back support, and then returned to a back support locking position in which the pressure pad is firmly in engagement with the channel member.

Thus a compact back support control mechanism is provided, simple to use and generally obscured from view, permitting infinite adjustment of the back support with respect to the seat.

The invention will be more completely understood by reference to the following detailed description of a presently preferred embodiment thereof.

DETAILED DESCRIPTION

Figure 1:
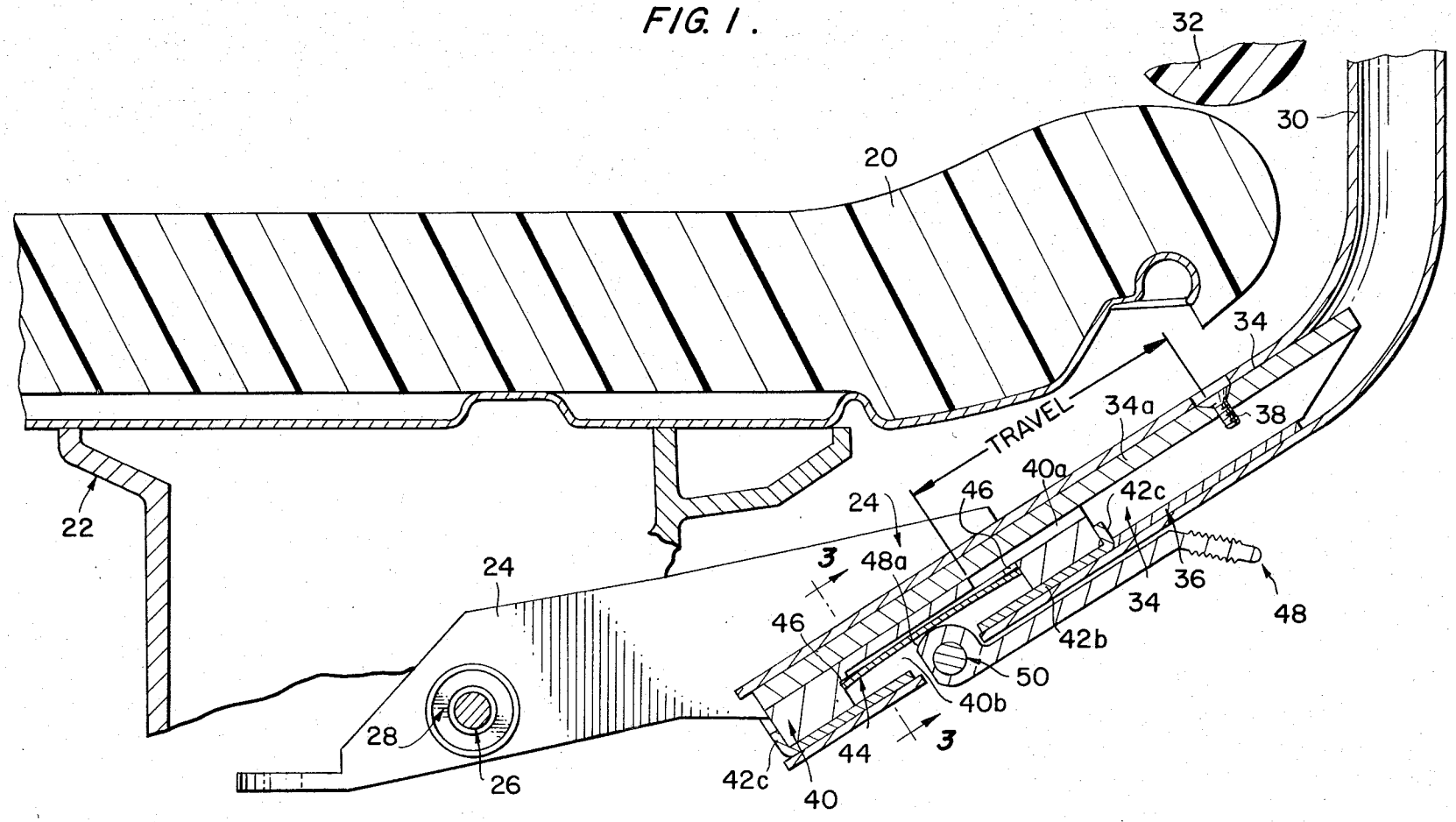
FIG. 1 is a side view, in section, of a back support control mechanism embodying the invention.
Figure 2:
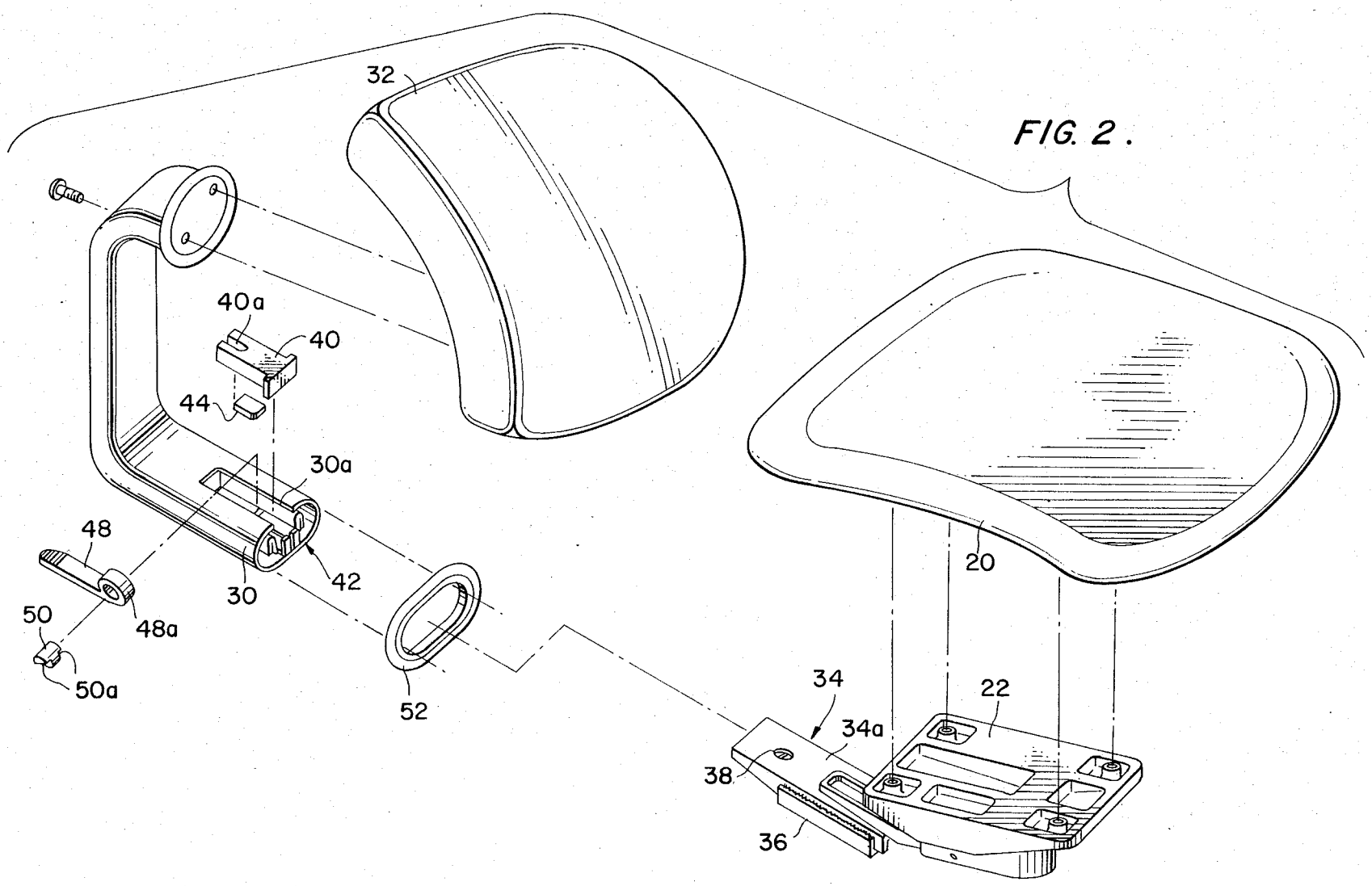
FIG. 2 is an exploded view of the back support control mechanism of FIG. 1.
Figure 4:
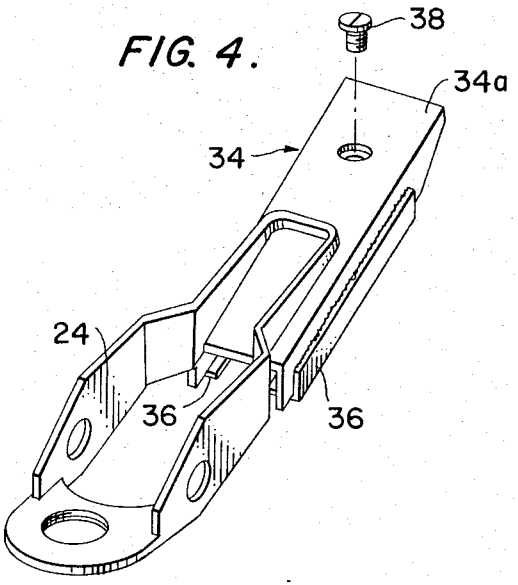
FIG. 4 is a perspective view of the channel member used in the back support control mechanism of FIG. 1.

Referring to FIG. 1, a presently preferred embodiment of the invention is shown in the environment of a chair which includes a seat 20 that is supported by a seat support 22. A back support pivot plate 24 is mounted for pivotal movement with respect to the seat support 22 by a pivot pin 26 mounted in bushing 28. A tubular back support 30 is included that carries a back support cushion 32 shown also in FIG. 2. The back support cushion 32 and the seat cushion 20 are mounted for relative adjustment toward and away from each other throughout a range of movement indicated in FIG. 1 by the designation "travel".

Figure 5:
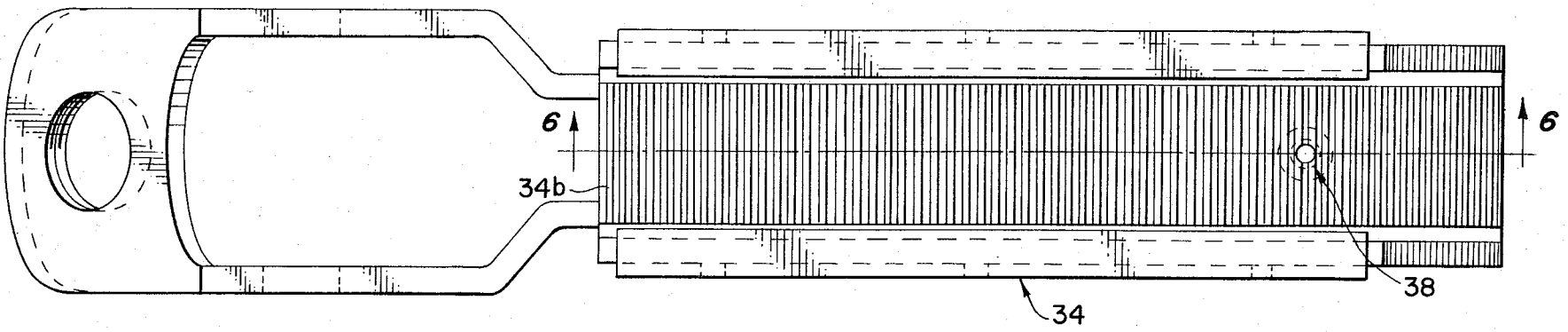
FIG. 5 is a bottom view of the channel member shown in FIG. 4.
Figure 6:
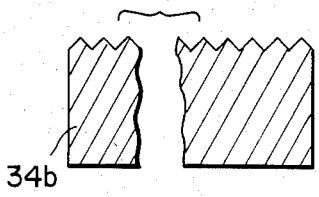
FIG. 6 is a sectional view of the channel member of FIG. 5, taken along the section 6—6 in FIG. 5.
Figure 7:
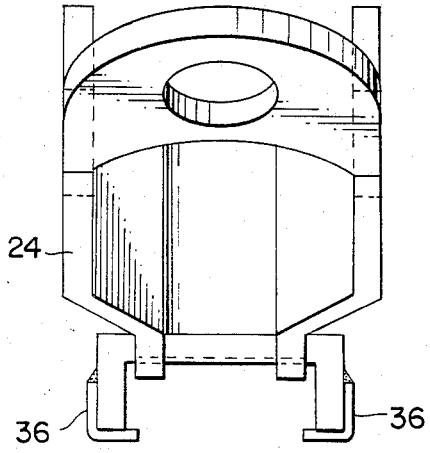
FIG. 7 is an end view of the channel member of FIG. 5.
Figure 8:
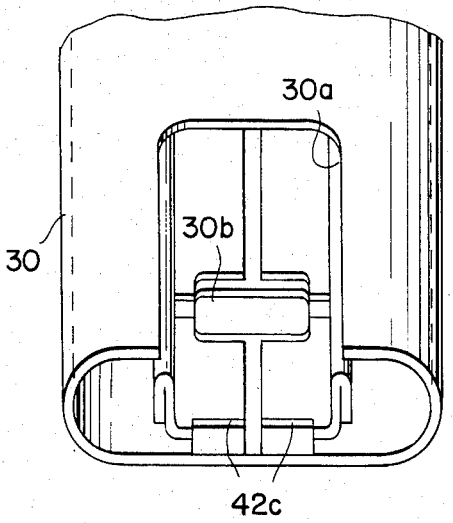
FIG. 8 is a front view of a portion of the back support tubing shown in FIG. 1.
Figure 9:
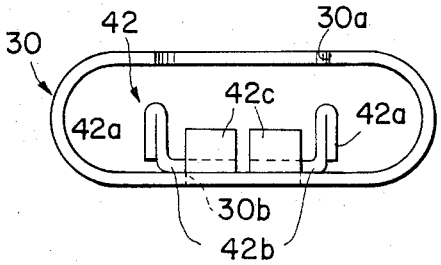
FIG. 9 is an end view looking directly into the back support tubing shown in FIG. 8.
Figure 10:
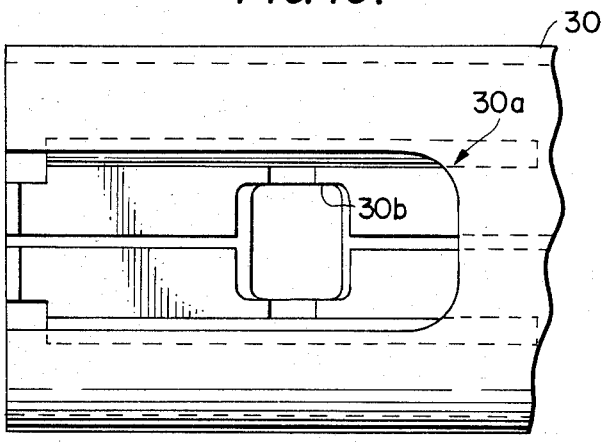
FIG. 10 is a top view of the back support tubing of FIG. 8.
Figure 11:
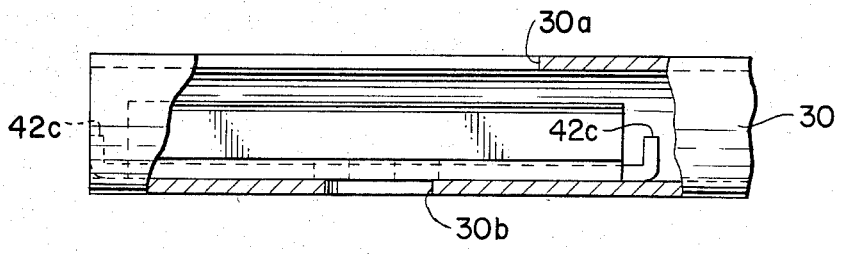
FIG. 11 is a side view, partly in section, of the back support tubing of FIG. 8.
Figure 12:
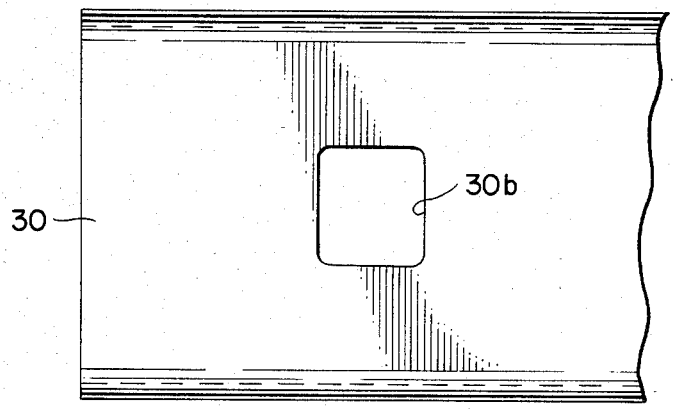
FIG. 12 is a bottom view of the back support tubing of FIG. 8.

With reference to FIGS. 1 to 4, the back support pivot plate 24 includes a channel member 34 as a part thereof. Channel member 34 is generally U-shaped in section (open downwardly or away from the seat cushion 20) and carries two L-shaped members 36 along the sides thereof that are welded thereto. The L-shaped members 36 form tracks, as will be explained in more detail below. A stop pin 38 is included, which is threaded into top plate **34*a* of the channel member 34, used to define the outer limit of movement of the back support 30, as will be explained in more detail below. The channel member 34** is shown in more detail in FIGS. 5–7. It is ridged on the underside of the top plate 34*a*, as at 34*b* as shown in FIGS. 5 and 7, for the purpose of securely gripping a pressure pad, as described below.

Figure 3:
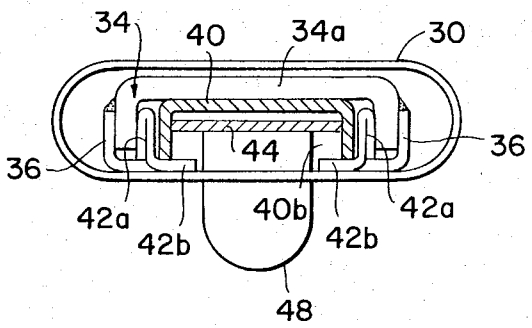
FIG. 3 is a sectional view taken along the section 3—3 in FIG. 1.
Figure 13:
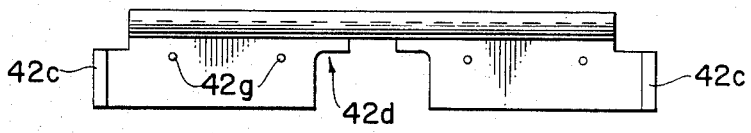
FIGS. 13 and 14 are respectively top and side views of a rail member included in the back support tubing of FIG. 8.
Figure 14:
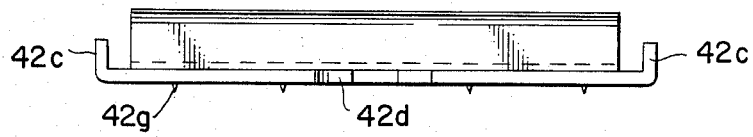
Figure 15:
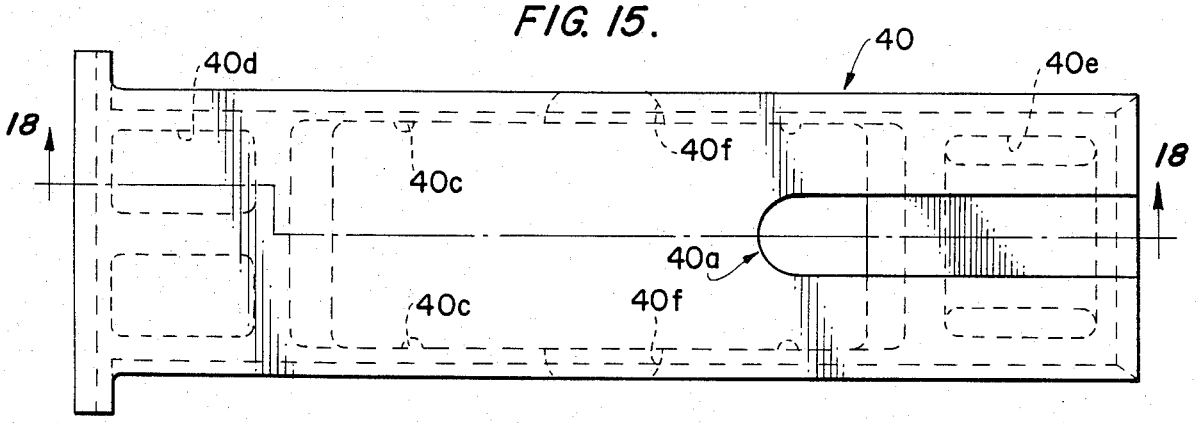
FIG. 15 is a top view of a pressure pad used in the back support control system of FIG. 1.
Figure 16:
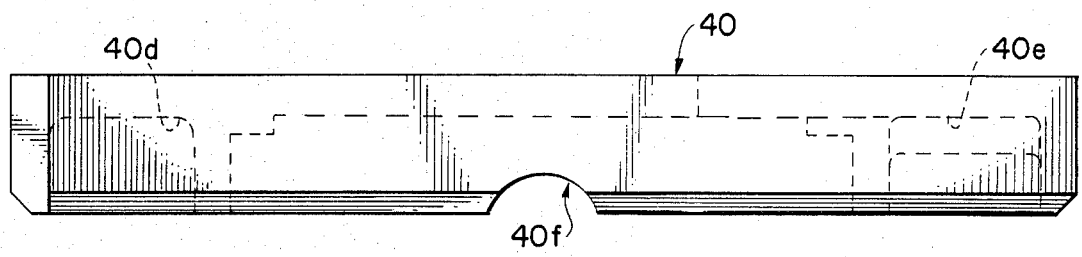
FIGS. 16 and 17 are respectively side and bottom views of the pressure pad of FIG. 15.
Figure 17:
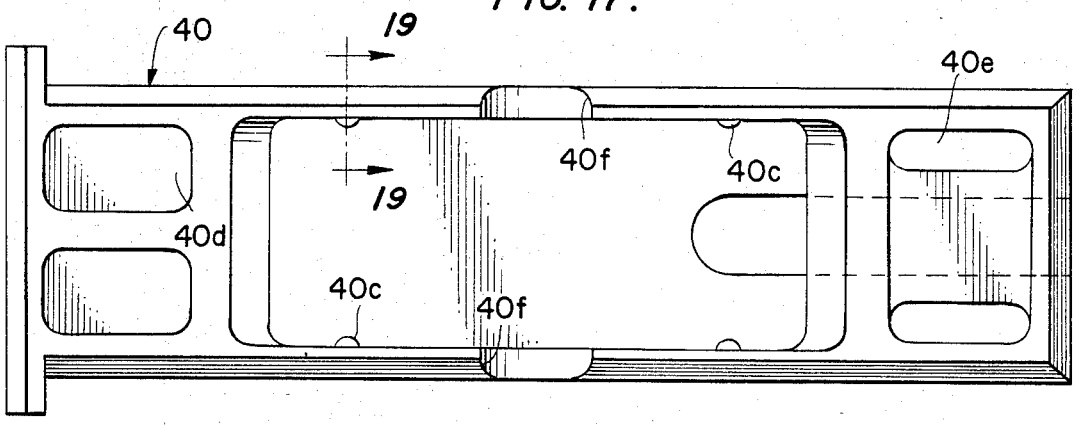
Figure 18:
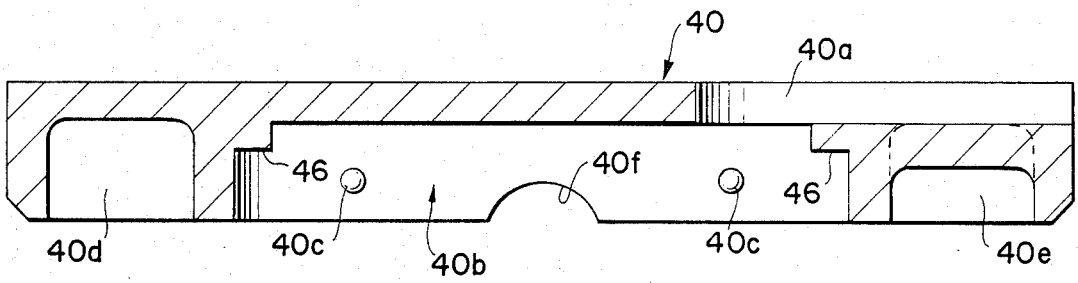
FIGS. 18 and 19 are sectional views respectively taken along the sections 18 and 19 in FIGS. 15 and 17.
Figure 19:
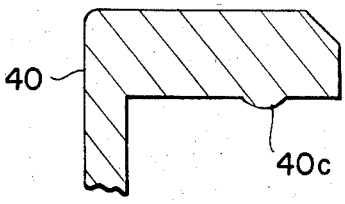
Figure 20:
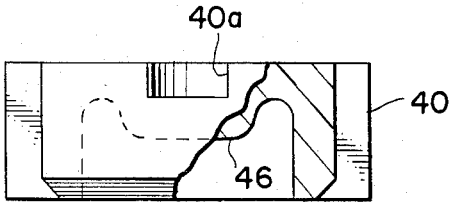
FIG. 20 is an end view, partly in section, of the pressure pad of FIG. 15.

The back support tubing 30 is slotted (see FIGS. 2 and 8–11), as at 30*a*, to permit a pressure pad 40 (FIGS. 1 and 2) to be placed within the tubing. The pressure pad 40 is carried within the tubing 30 by a carrier 42, defined by two L-shaped rail members 42*a*. The rail members, shown in detail in FIGS. 13 and 14, are spot welded along their bottoms 42*b* to the tubing 30, as at weld points 42*g* in FIGS. 13 and 14. The pressure pad 40 is supported by the upper surfaces of the bottom pieces 42*b* between the side rails 42*a*, as shown in FIG. 3. Each rail member includes upstanding lugs 42*c* at the ends thereof to hold the pressure pad 40 in place.

The pressure pad 40, shown in FIGS. 1–3 and 15–20, is slotted, as at 40*a*, and also includes a cavity 40*b* on the underside thereof. A spring plate 44 (FIGS. 1 and 3) is positioned within the cavity, bearing against spaced points therein defined by ledges 46. As is evident from FIG. 1, the spring plate 44 thus may be bowed between the ledges. Dimples 40*c* (FIGS. 15 and 17–19) serve to hold the spring plate 44 within cavity 40*b* during assembly. Cavities 40*d* and 40*e* (FIGS. 15–18) are simply to conserve material.

A lever 48 (FIGS. 1 and 2) is included which is carried by the tubing 30. In particular, the lever 48 is pivotable about pin 50 carried by the tubing (the pin clears half-round cutouts 40*f* in pressure pad 40—FIGS. 15–18; the pin includes lands 50*a* at the ends thereof which rest on the interior of the tube 30 and are located within cutout 30*b* by rail members 42). The lever 48 (extending through cutout 30*b* in tubing 30—FIGS. 1 and 8 to 12—and through cutouts 42*d* in rail members 42—FIGS. 13 and 14) includes a cam surface 48*a* which acts against the spring plate 44. In particular, in the position of the lever 48 shown in FIG. 1, the cam surface 48*a* bears firmly against the spring plate 44, urging the pressure pad 40 firmly against the channel member 34 (specifically against the underside of the top plate portion 34*a* of the channel member). In the position of the lever 48 shown in FIG. 1, the back support cushion 32 is thus fixed in position with respect to the seat cushion 20. When it is desired to change the relative positioning of the two cushions, the lever 48 is pivoted clockwise (with respect to FIG. 1) about the axis of pin 50, thereby to relieve the pressure exerted by the cam surface 48*a* against the spring plate 44. The pressure of the pressure pad 40 against the channel member 34 is thus relieved, permitting the back support tubing 30 that carries the pressure pad 44 to be moved to a desired position, after which the lever 48 is pivoted counterclockwise to return to the position shown in FIG. 1, to lock firmly the back support cushion 32 in its new position.

As is evident from FIG. 3, movement of the back support tubing 30 with respect to the channel member 34 is effected by the riding of the rails 42*a* on the side pieces 36 of the channel member 34. The side pieces 36 thus serve as tracks along the side of the channel member.

The slot 40*a* in the pressure pad 40, along with the screw 38, serves to define the limits of movement of the back support tubing 30. The screw 38 constitutes a stop pin, which rides within the slot 40*a*. The back support tubing 30 may be moved to the right (with respect to FIG. 1) until the stop pin strikes the end of the slot 40*a*. When it is desired to remove the back support altogether, the screw 38 is removed, permitting the back support tubing to be completely disengaged from the channel member 34. A back support cap 52 is included (FIG. 2) to finish off the assembly.

The invention thus provides a compact mechanism for providing back support adjustment. By use of the spring plate 44, manufacturing tolerances are not critical, since the spring, as activated by the cam surface 48*a*, urges the pressure pad 40 against the channel member 34 regardless of variations in those tolerances.

The presently preferred embodiment described above is obviously subject to modification by those skilled in the art, without departing from the spirit and scope of the present invention. Accordingly, that invention should be taken to be defined by the following claims.

What is claimed is:

1. In a back support control mechanism for a chair or the like in which said back support is mounted for movement toward and away from a seat, the improvement for providing adjustable positioning of said back support with respect to said seat in an infinite number of positions in a range of movement of said back support comprising a channel member fixed with respect to said seat, a pressure pad positioned within said channel member and fixed with respect to said back support, said channel member permitting sliding movement of said pressure pad with respect thereto resulting in movement of said back support over said range of movement, and a lever coupled to said pressure pad and movable therewith and with respect thereto and having a cam surface thereon which, in one position of said lever with respect to said pressure pad, bears against said pressure pad, causing the latter to bear against said channel member to fix said pressure pad in position with respect to said channel member and to prevent further movement of said pressure pad, thereby fixing the position of said back support with respect to said seat, in which said back support comprises a tubing that includes a carrier therein that holds said pressure pad, said carrier includes side rails, with said pressure pad being supported between said side rails, said channel member is positioned within said tubing, and said channel member includes tracks along the sides thereof, and said side rails of said carrier ride along said tracks.

2. A back support control mechanism according to claim 1, in which said pressure pad includes a cavity therein, and a spring plate positioned within said cavity and bearing against spaced points therein, said cam surface of said lever bearing directly against said spring plate to apply pressure against said pressure pad at said spaced points.

3. A back support control mechanism according to claim 2, in which said spaced points are defined by ledges, permitting the bowing of said spring plate between said ledges.

4. A back support control mechanism according to claim 1, in which said channel member includes a stop pin therein, and said pressure pad is slotted for a length limiting said range of movement of said back support, and said stop pin is positioned within said slot.

* * * * *